US007723680B2

(12) United States Patent
Hidalgo et al.

(10) Patent No.: US 7,723,680 B2
(45) Date of Patent: May 25, 2010

(54) ELECTRON MULTIPLIER HAVING ELECTRON FILTERING

(75) Inventors: August Hidalgo, San Francisco, CA (US); Kenneth L Staton, San Carlos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 291 days.

(21) Appl. No.: 11/897,693

(22) Filed: Aug. 31, 2007

(65) Prior Publication Data

US 2009/0057548 A1 Mar. 5, 2009

(51) Int. Cl.
*H01J 40/00* (2006.01)

(52) U.S. Cl. ..... 250/305; 250/281; 250/282; 250/396 R; 250/397; 313/103 R; 313/103 CM; 313/104; 313/105 R; 313/105 CM

(58) Field of Classification Search ..... 250/289, 250/305, 397; 313/103 R, 103 CM, 104, 313/105 R, 105 CM
See application file for complete search history.

(56) References Cited

U.S. PATENT DOCUMENTS 6,617,768 B1 * 9/2003 Hansen ..... 313/103 CM
6,680,476 B1 * 1/2004 Hidalgo et al. ..... 250/286
7,105,807 B2 9/2006 Hansen
2006/0163468 A1 * 7/2006 Wells et al. ..... 250/281

OTHER PUBLICATIONS http://www.etpsci.com/pdfs_local/brochures/BR-0184-A.pdf; ETP Electron Multipliers product brochure for Electron Multipliers for Mass Sectrometry; Published Aug. 2004; 8 pages.

http://www.eaglabs.com/training/tutorials/sims_instrumentation_tutorial/detector.php dated Aug. 17, 2004; 8 pages.

* cited by examiner

*Primary Examiner*—Jack I Berman
*Assistant Examiner*—Hanway Chang

(57) ABSTRACT

A system for detecting ions is disclosed. The system includes a detector having a plurality of dynodes arranged in an electron cascading configuration, and a power supply circuit electrically coupled to the plurality of dynodes. The plurality of dynodes include a first dynode and a second dynode. The power supply circuit is arranged to selectively adjust a potential difference between the first and second dynodes between a detection mode and a blanking mode. A method of detecting ions is also disclosed.

24 Claims, 5 Drawing Sheets

ELECTRON MULTIPLIER HAVING ELECTRON FILTERING

BACKGROUND

Time of flight (TOF) mass spectrometers are used to analyze the composition of a sample. The sample is ionized, accelerated through a vacuum, and caused to impact an ion detector. Ions having a higher mass accelerate more slowly through the vacuum than ions having a lower mass. As a result, the time of flight mass spectrometer measures the time of flight of the ions, which is then used to identify the mass of the ion. This information is then used to identify the content of the sample.

One type of detector used in TOF mass spectrometers includes an electron multiplier. The ions enter the electron multiplier and strike a dynode. In response, the dynode releases a plurality of electrons in response to each ion that strikes it. Those ions then pass to and strike another dynode. The second dynode then releases multiple electrons in response to each electron that strikes it. This process repeats for several stages of dynodes until enough electrons are generated to induce an electrical current. The current is measured and the time at which the current is induced corresponds to the time it took the ion to pass from the ion source to the electron multiplier.

A difficulty arises when the sample includes constituents that are not of interest for analysis. For example, some TOF mass spectrometers are commonly used to test the composition of a discrete sample of ambient environment such as air for the presence of any undesirable constituents such as pollution, poisons, and explosives. The instrument ionizes and samples all of the constituents that happen to be present, not just undesirable constituents that are of interest for analysis. However, the ionization and sampling includes high frequency and abundant molecules such as oxygen and nitrogen even though their presence is known and not of interest.

A difficulty is that the dynodes degrade with use, and frequently ionizing and sampling high abundance molecules that are not of interest shortens the dynode's useful life. One technique that has been used to prevent sampling ions that are not of interest is to add an arrangement of electrodes in the mass spectrometer that deflect the undesired ions from the ion path before they reach the electron multiplier. However, these arrangements are expensive, difficult to switch, consume energy, and add bulk to the mass spectrometer.

SUMMARY

In general terms, this patent is directed to an electron multiplier having multiple dynodes. The voltage applied to at least one of the dynodes is adjusted to selectively prevent or satisfactorily reduce the flow of electrons through the electron multiplier.

One aspect is a detector for detecting ion impact. The detector comprises a plurality of dynodes and a power supply circuit. The plurality of dynodes are arranged in an electron cascading configuration and include at least a first dynode and a second dynode arranged to receive electrons from the first dynode and defining a path. The power supply circuit is electrically coupled to the plurality of dynodes and includes the first and second dynodes, wherein the power supply circuit is arranged to selectively adjust a potential difference between the first and second dynodes between a first state in which the second dynode has a greater voltage than the first dynode and a second state in which the second dynode has a voltage substantially similar to or less than the first dynode.

Another aspect is a detector for detecting ion impact. The detector comprises an ion source, ion optics, a flight tube, a plurality of dynodes, and a power supply circuit. The ion source ionizes a sample to generate ions. The ion optics receive and focus the ions from the ion source. The flight tube is positioned to define an ion path for the ions from the ion source. The plurality of dynodes are in an electron cascading configuration and are arranged to receive the ions from the ion path. The plurality of dynodes define an electron path and comprise at least a first dynode; a second dynode arranged to receive electrons from the first dynode; a third dynode arranged immediately upstream of the first dynode along the electron path to supply electrons to the first dynode; and a fourth dynode arranged immediately downstream of the second dynode along the electron path to receive electrons from the second dynode. The power supply circuit is electrically coupled to the plurality of dynodes. The power supply circuit comprises a plurality of resistive elements, each resistive element electrically connected between adjacent dynodes of the plurality of dynodes arranged in the electron cascading configuration; a pulse generator electrically coupled to the second dynode to selectively adjust a potential difference between the first and second dynodes between a first state in which the second dynode has a greater voltage than the first dynode and a second state in which the second dynode has a voltage substantially similar to or less than the first dynode; a first capacitive coupling electrically coupled between the power source and the third dynode to maintain a substantially constant third dynode voltage throughout the first state and the second state; and a second capacitive coupling electrically coupled between the fourth dynode and ground to maintain a substantially constant fourth dynode voltage throughout the first state and the second state.

Yet a further aspect is a method of detecting ions. The method comprises receiving ions from an ion source, the ions including an unwanted constituent; detecting impacts of the ions with a detector; and inhibiting detection of impacts of the unwanted constituent.

DETAILED DESCRIPTION

Figure 1:
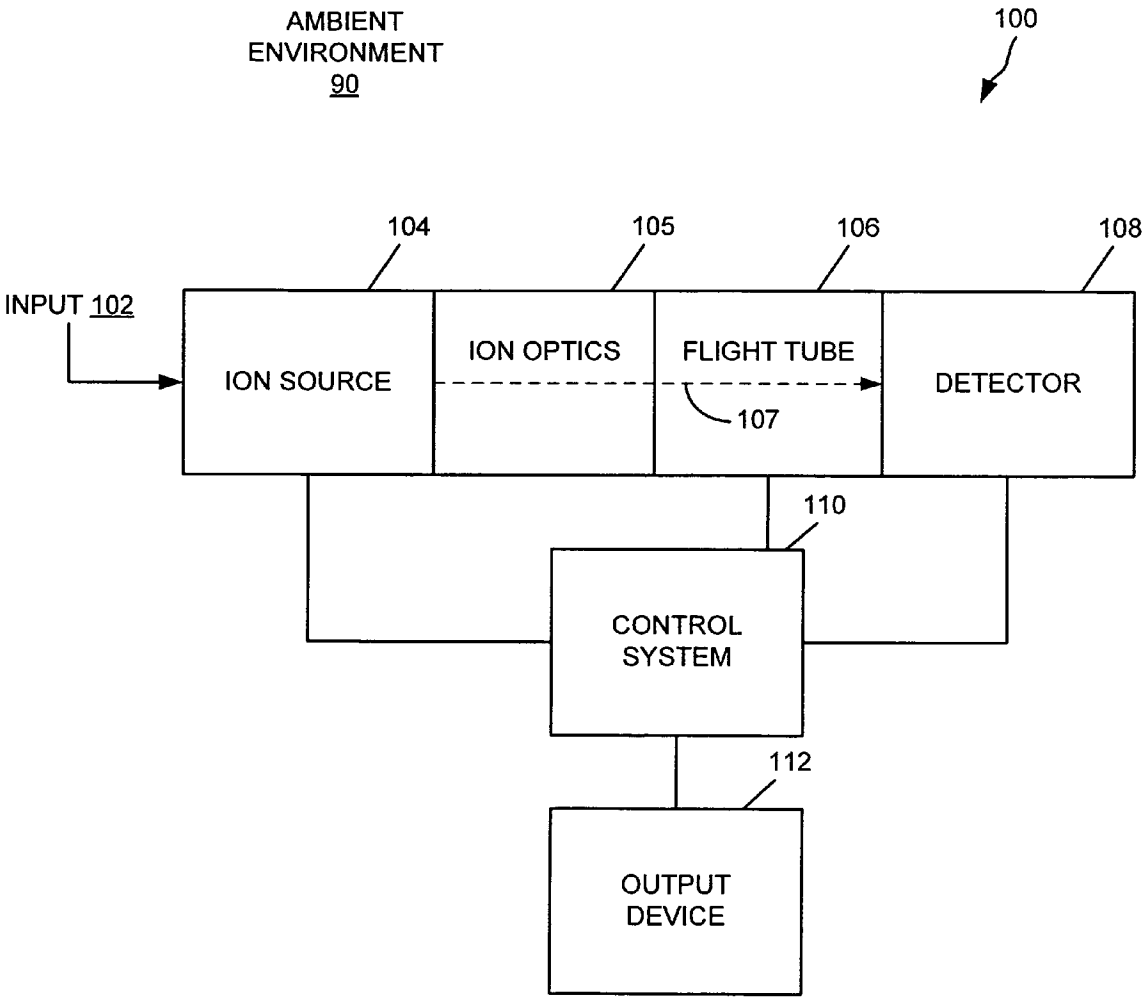
FIG. 1 is a block diagram illustrating an example time of flight mass spectrometer including a detector according to the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a block diagram illustrating example time of flight mass spectrometer 100 that is one possible application for the electron multiplier described herein. Mass spectrometer 100 includes inlet 102, ion source 104, ion optics 105, flight tube 106, ion path 107, detector 108, control system 110, and output device 112. In this exemplary embodiment, mass spectrometer 100 operates to detect the content of samples of ambient environment 90, although other embodiments can analyze other types of samples. In various embodiments, any or all of these components can operate in a vacuum or at atmospheric pressure. Furthermore, other embodiments can include different combinations of components to form the mass spectrometer.

The mass spectrometer 100 is useful in analyzing the content of a sample, such as ambient environment 90. In an exemplary embodiment, the mass spectrometer 100 performs continuous air monitoring to detect the presence (or absence) of a toxic chemical, an explosive substance, a pollutant, or various other chemicals or compositions in the ambient environment 90. Upon detection, mass spectrometer 100 provides an output relating to the results of the analysis. Alternatively, mass spectrometer 100 generates an alarm signal, adjusts an operating mode of a machine or other device, or takes some other type of action upon detecting the presence of a predetermined compound in the ambient environment 90 or the presence above a certain threshold level within the ambient environment. Other embodiments analyze samples from sources other than an ambient environment.

A sample of ambient environment 90 is first received through inlet 102. In an exemplary embodiment, inlet 102 is a pump for pumping samples of ambient environment 90 into ion source 104. In other possible embodiments, inlet 102 is an inlet such as a vent, valve, hose, nozzle, or port through which a sample of ambient environment 90 is received into mass spectrometer 100. In such alternative embodiments the sample can be drawn through inlet 102 by a vacuum or some other mechanism.

The sample flows through inlet 102 and to ion source 104. Possible embodiments of ion source 104 include a radioactive ionization source, a plasma source, an electron ionization source, and a chemical ionization source. An example of a radioactive ionization source is nickel-65. Examples of plasma sources include resonant rings and dielectric barrier discharge devices. In an example electron ionization source, electrons are produced through thermionic emission by heating a wire filament using an electric current and passing the gas-phase sample near it. In a chemical ionization source, the sample is ionized by chemical reactions that occur between the sample and a reagent, such as methane, isobutane, or ammonia. Other possible embodiments of ion source 104 ionize the source using glow discharge, field desorption, fast atom bombardment, thermospray, desorption/ionization on silicon, Direct Analysis in Real Time, atmospheric pressure chemical ionization, secondary ion mass spectrometry, spark ionization, thermal ionization, or other ionization techniques. While certain embodiments of the ion source are described herein, the ion source 104 can include other structures and arrangements and can use yet other techniques for ionizing the sample.

An arrangement of ion optics 105 receives the ions from the ion source 102, focuses them onto an ion path, and passes them into the flight tube 106. In an exemplary embodiment, the first arrangement of ion optics 104 includes a skimmer (not shown) that collimates the ions into an ion stream flowing along an ion path that pass through the flight tube 106 and into the detector 108. In various embodiments, the ion optics 105 also includes an electrode arrangement (not shown) that accelerates the ions along the ion path, adjusts the phase and frequency of the ions so that they enter the first mass analyzer 106 at predetermined levels, and adjusts the timing of when the ions are released into the flight tube 106 so that the exact time of flight between the ion optics 105 and the detector 108 can be determined. While certain components for the ion optics 105 are described herein, the ion optics can include other structures and arrangements Sample ions flow from the ion optics and into flight tube or other drift region 106, which defines an ion path 107 between the ion optics 105 and the detector 108. The ion path 107 has a distance over which ions of different masses are separated due to their different velocities. In an exemplary embodiment, flight tube 106 is a conductive cylinder that is grounded to reduce or eliminate stray fields from affecting the flight of sample ions. While a certain structure for the flight tube 106 is described, the mass spectrometer 100 can include any structure that defines an ion path leading to the detector 108. For example, other embodiments can include additional electrode arrangements for accelerating ions traveling along the ion path or as a mass filter for passing desired ions from the ion path. Quadrapole electrode arrangements are examples of such additional electrode arrangements.

The ion path has a known length, which is useful to calculate the time of flight of ions that pass from the ion optics 105 to the detector. Each type of ion has a different mass and hence a different time of travel from the ion optics 105 to the detector 108. Accordingly, by measuring the time of travel along the ion path 107 from the ion optics to the flight tube, the system can calculate the mass of each detected ion and hence determine what type of ion it is. The relationship between the flight time and the mass can be written in the form:

$$\text{Time}=k\sqrt{m}+c$$

where k is a constant related to flight path and ion energy, m is the mass of the ion, and c is a small decay time, which may be introduced by the signal cable and/or detection electronics.

Figure 2:
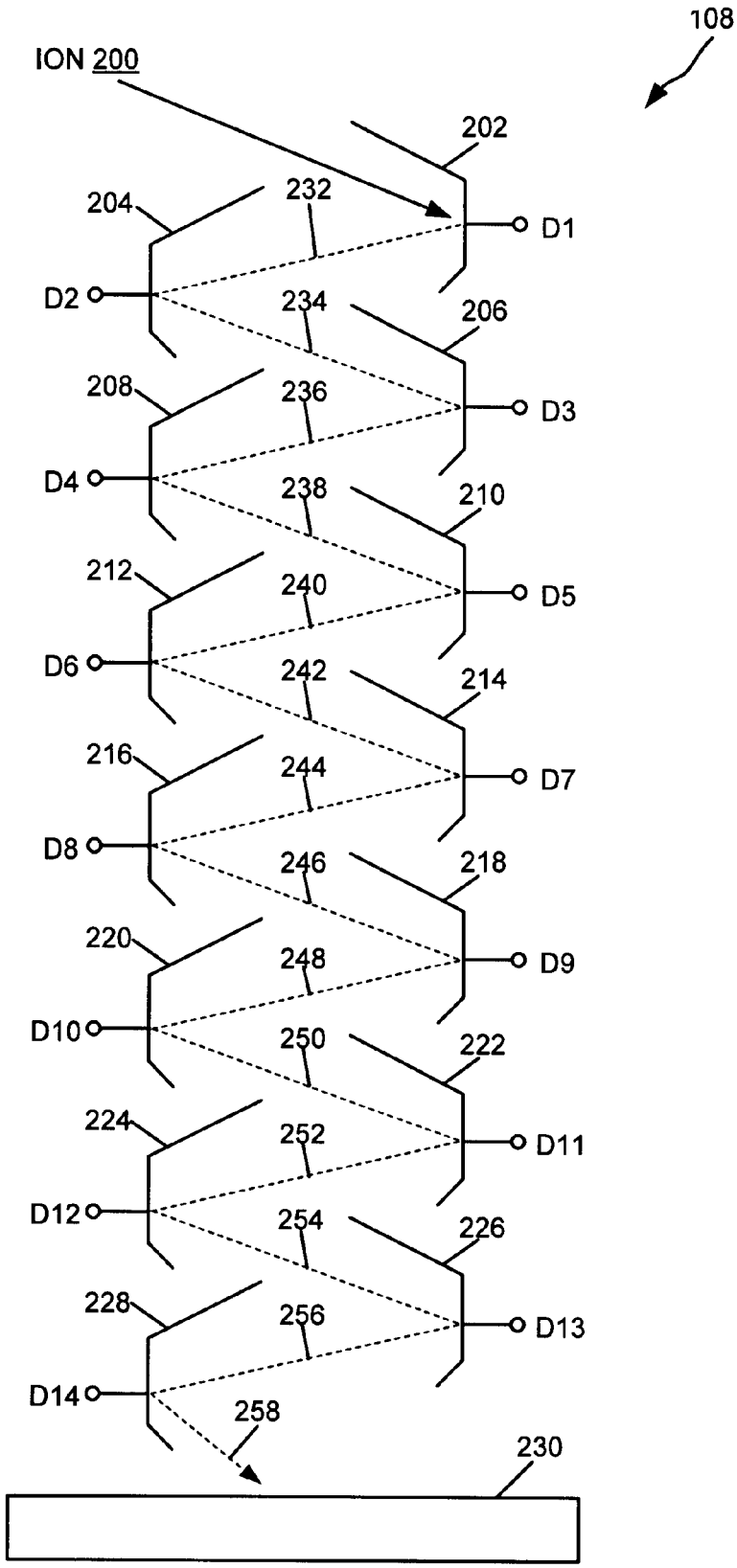
FIG. 2 is a cross-sectional view of an exemplary embodiment of the detector shown in FIG. 1.

Ions pass from flight tube 106 and enter detector 108, which includes an electron multiplier such as the one illustrated in FIG. 2 and described in more detail herein. Detector 106 detects the impact of the ions and provides an output to the control system 110. Although certain types of detectors and structures of an ion detector are described herein, other embodiments can include other structures and arrangements of electrodes, dynodes, and circuits.

Control system 110 performs control functions for mass spectrometer 100. In possible embodiments, control system 110 is communicatively coupled to ion source 104, flight tube 106, detector 108, and output device 112. In other embodiments, control system 110 is only communicatively coupled to some of these devices. The exemplary embodiment of control system 110 synchronizes the operation of mass spectrometer 100 and provides precise time measurements from a starting point (e.g., an electrode in the ion optics 105) to the detector 108. An exemplary embodiment of control system 110 includes a high frequency clock or other timing mechanism such as a timer for determining the time of flight of ions. For example, the high frequency clock is sometimes used to set a start time that is synchronized with release of the ions from the ion optics 105 to the flight tube 106 and an end time that is set when the ions are detected by the detector 108.

In one possible embodiment, control system 110 is a field-programmable gate array. Other possible embodiments of control system 110 include other types of processing devices, such a microprocessor, central processing unit ("CPUs), multiple CPU, microcontroller, programmable logic devices, digital signal processing ("DSP") device, and the like. Some embodiments of processing devices are of any general variety such as reduced instruction set computing (RISC) devices, complex instruction set computing devices ("CISC"), or specially designed processing devices such as an application-specific integrated circuit ("ASIC") device.

Output device 112 is an interface device for communicating data relating to an analysis of a sample. In the illustrated embodiment, output device 112 is communicatively connected to and under the control of control system 110. In some possible embodiments, output device 112 is a user interface. Examples of user interfaces include output devices, such as a display, speaker, alarm, and printer, and input devices such as a keyboard, mouse, pen input device microphone, touch screen, and other input devices. In other possible embodiments, output device is a communication device. Examples of communication devices include a network communication device, a communication port, a wireless communication device, and other communication devices. In one embodiment, the output from output device 112 is a spectrum illustrating or representing the content of the sample.

FIG. 2 is a cross-sectional view of an exemplary embodiment of detector 108. Detector 108 includes a plurality of dynodes, represented by even numbers from 202 to 228 (sometimes referred to herein generally as "dynodes 202-228"), and electrode 230.

Figure 3:
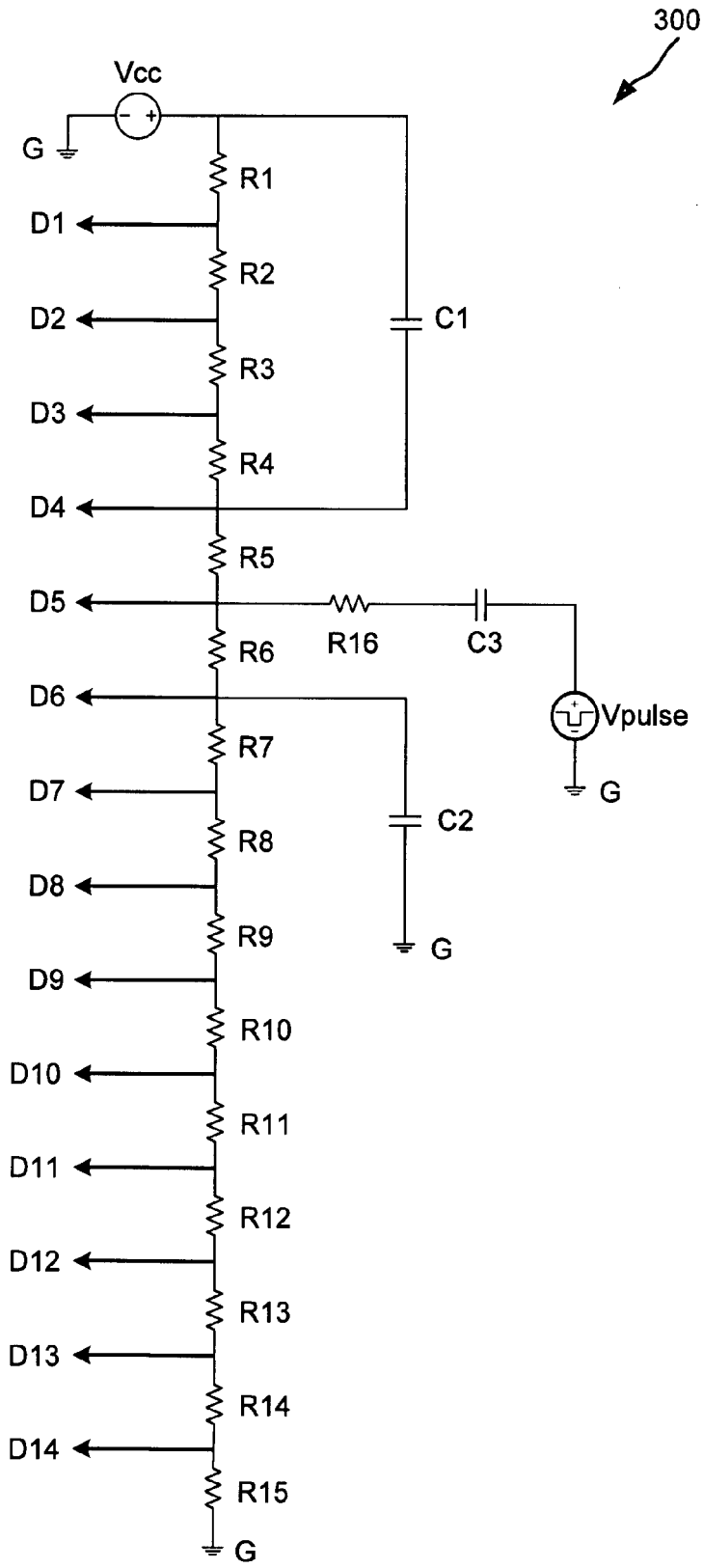
FIG. 3 is an electrical schematic diagram of an exemplary embodiment of a power supply circuit of the detector shown in FIG. 1.
Figure 4:
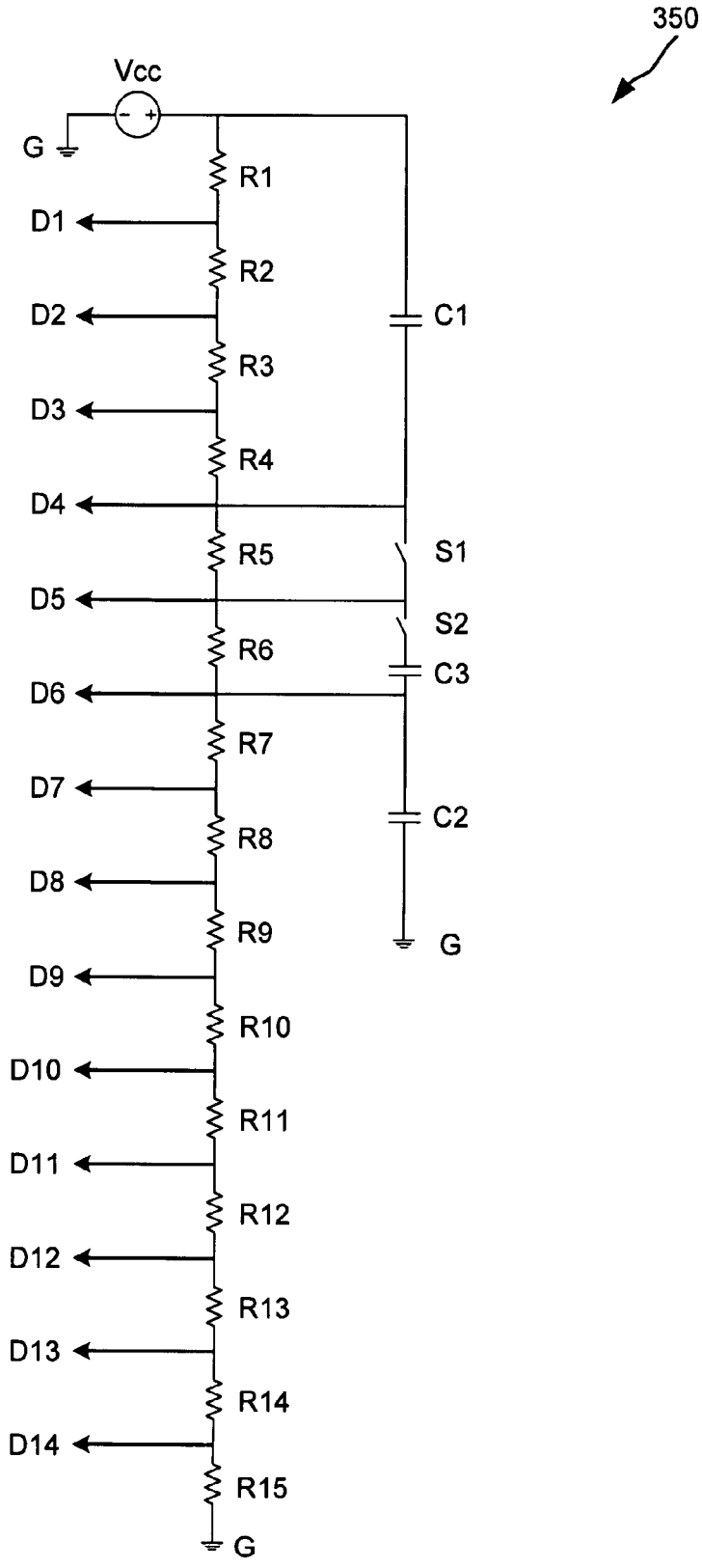
FIG. 4 is an electrical schematic diagram of another exemplary embodiment of a power supply circuit of the detector shown in FIG. 1.

In some embodiments, the plurality of dynodes 202-228 are polished metal electrodes that are electrically coupled to a power supply circuit (such as shown in FIGS. 3-4). The plurality of dynodes are arranged in an electron cascading configuration to define an electron path, represented by even numbers from 232 to 258 (sometimes referred to herein generally as "electron path 232-258"). In possible embodiments, electron cascading involves a process by which electrons ejected from one dynode (e.g., dynode 202) cascade downstream along the electron path 232-258 (e.g., to dynode 204, and then to dynode 206, etc.). Some embodiments of dynodes 202-228 include a surface treatment that increases the ability of the dynode to emit secondary electrons.

An example is illustrated in FIG. 2. An ion 200 (such as originating from ion source 104 and passing through flight tube 106, shown in FIG. 1) is supplied to detector 108, which is interposed along the ion path. The ion is directed toward dynode 202 of the plurality of dynodes, and as a result impacts with dynode 202. The impact of ion 200 with dynode 202 causes dynode 202 to emit electrons. This process is sometimes referred to as secondary emission. Secondary emission is the process in which surface electrons present on the dynode are emitted from the dynode upon impact with the ion or an electron.

A power supply circuit (e.g., shown in FIGS. 3-4) is electrically coupled to the plurality of dynodes (e.g., D1-D14), and operates to charge the plurality of dynodes 202-228 with a potential that increases for each dynode 202 downstream along the electron path. For example, dynode 204 has a greater potential than dynode 206. As a result, an electric field is generated between dynode 202 and 204 that draws the electrons emitted from dynode 202 toward dynode 204, generally along path 232.

When the electrons from dynode 202 impact dynode 204, the energy of the electrons is sufficient to cause secondary emission at dynode 204. This secondary emission results in each electron causing dynode 204 to emit one or more electrons. Typically multiple electrons are emitted for each impact of an electron with one of the plurality of dynodes 202-228.

The power supply circuit generates a potential on dynode 206 that is greater than dynode 204, generating an electric field between dynode 204 and 206. The electric field causes he electrons emitted from dynode 204 to be drawn toward dynode 206, generally along path 234. The electrons impact with dynode 206, themselves causing a secondary emission of one or more electrons. Typically multiple electrons are emitted. This process continues along electron path 232-258, and acts to increasingly multiply the number of electrons moving along electron path 232-258 with each impact with a dynode. As a result, a single impact of ion 200 with dynode 202 can result in a large number of electrons moving along electron path 232-258.

In the exemplary embodiment, detector 108 includes fourteen dynode plates 202-228. Other embodiments of detector 108 include various numbers of dynode plates. The number of dynode plates is generally a trade off between the gain of the detector and peak width of the resulting output. For example, the greater the number of dynode plates, the greater the gain of the detector, because each dynode plate increases the number of electrons moving along the electron path. On the other hand, the electrons do not all move in precisely the same path. Some electrons will follow a shorter distance path, while other electrons will follow a longer distance path, resulting in a range of distances of electron travel. With each added dynode, this range of distances increases accordingly. Those electrons that follow a shorter-distance path will pass through the detector in a shorter period of time than electrons that follow a longer-distance path. Therefore, the peak width of the resulting output signal is increased with each added dynode plate. If too many dynode plates are included, the output signal generated from one type of ion may become indistinguishable from the adjacent output signal generated from another type of ion.

Some embodiments of detector 108 include a number of dynode plates in a range from about five dynode plates to about twenty-four dynode plates. This range has been found to be sufficient to generate sufficient gain, while maintaining adequate separation between output pulses of adjacent ions. Another possible embodiment includes about fifteen dynode plates. Fifteen dynode plates provides increased gain over embodiments with fewer dynode plates, but maintains a good separation between output pulses from adjacent ions. Other embodiments include various other numbers and arrangements of dynode plates.

In some embodiments, after the electrons have traveled downstream along the electron path 232-258 they are collected by electrode 230. In some possible embodiments, electrode 230 is connected to a load, such as a 50 ohm load, and acts like a current source to the load. The current is then detected in any desired manner, such as by a voltage meter across the 50 ohm load. Other possible embodiments do not include a separate electrode 230, but rather the final dynode (e.g., dynode 228) performs this function.

Some possible embodiments described herein are operated to prevent or satisfactorily reduce the flow of electrons and thereby blank out the detection of known high abundance ions to suppress the electron flow caused by these ions. In this way the effective life of the detector is increased in some embodiments. Because the high abundance ions are already known to be present, there is not a need to continually analyze the sample for the presence of these ions. Other embodiments are operated to blank out undesired ions that are not in high abundance.

Another advantage is that blanking out detection can eliminate or reduce the need for mass ion filters such as quadrapole electron arrangements or an ion deflecting pulse in the flight path. Eliminating such filters simplifies the structure of the mass spectrometer and may permit a smaller and more compact mass spectrometer. However, other embodiments can use the electron multiplier described herein with ion filters or in a mass spectrometer that uses ion filters.

FIG. 3 is an electrical schematic diagram of an exemplary embodiment of a power supply circuit 300 of detector 108. Power supply circuit 300 includes a plurality of resistive elements R1-R15, a voltage source (Vcc), ground connections (G), and a pulse generator (Vpulse), and capacitive couplings C1 and C2. Power supply circuit 300 is electrically coupled to the plurality of dynodes 202-228 at D1-D14 (shown in FIG. 2).

In some embodiments, power supply circuit 300 supplies power to the plurality of dynodes 202-228. When operating in a detection state, power supply circuit 300 operates to apply a voltage gradient between the entry dynode (e.g., 202 at D1) and the exit dynode (e.g., 228 at D14).

In the illustrated embodiment, power supply circuit 300 includes a plurality of resistive elements R1-R15 connected in a series orientation from R1 to R15, forming a voltage dividing circuit. The first resistive element R1 of the plurality of resistive elements R1-R15 is connected to voltage source Vcc. The last resistive element R15 of the plurality of resistive elements R1-R15 is connected to ground.

In this example, the dynode plates are electrically coupled to the intersections of adjacent resistive elements R1-R15. For example, the first dynode plate 202 is electrically coupled between resistive element R1 and R2 (at D1). The second dynode 204 is electrically coupled between resistive element R2 and R3 (at D2), and so on. As a result, when the resistances of R1-R15 are substantially matched, the voltage drop is divided evenly across each of the resistive elements, such that a substantially equal potential difference exists between each dynode plate. In other embodiments, the resistances are not substantially matched and the voltage drop is not evenly divided across each of the resistive elements. In addition, other embodiments use other power supply circuits to energize the dynodes, rather than the plurality of resistive elements.

In the illustrated embodiment, power supply circuit 300 is operating in a negative mode, such that Vcc is negative compared to ground. In some embodiments Vcc is in a range from about −1000 volts to about −20,000 volts. This range of voltages generates a voltage difference between adjacent dynode plates that is sufficient to draw electrons downstream along electron path 232-258 (shown in FIG. 2). In another possible embodiment, Vcc is calculated by multiplying the voltage difference that is desired between adjacent dynodes by the number of dynodes. For example, if it is desired that the voltage difference between dynodes be about 100 volts, and there are fourteen dynodes, then Vcc is set at −1400 volts to achieve the desired 100 volt potential difference between each dynode.

In another possible embodiment, power supply circuit 300 is operated in a positive mode, such that Vcc is connected to the last resistive element (e.g., R15) in place of the ground connection, and the ground connection is made to resistive element R1 in place of Vcc. In this embodiment, Vcc is set to a positive voltage, such as in a range from about 1000 volts to about 20,000 volts. Other possible embodiments do not have a ground connection at either end of resistive elements R1-R15, but rather have two sources that generate a desired potential difference between R1 and R15.

During the detection mode, power supply circuit 300 operates to maintain a substantially equal potential difference between each dynode. Power supply circuit 300 also operates in a blanking mode. During the blanking mode, some embodiments of power supply circuit 300 operate to adjust the potential difference between two or more adjacent dynodes, such that the voltage is substantially similar to each other. In other embodiments, the voltage at one dynode is adjusted such that it is less than the voltage at an adjacent upstream dynode. When the voltage across two adjacent dynodes is substantially similar, the electric field between the two dynodes is reduced, eliminated, or reversed, such that electrons are not drawn to the downstream dynode. Similarly, if the voltage at a dynode is less than an adjacent upstream dynode, the electric field between the two dynodes resists the electron movement from the upstream dynode to the downstream dynode. In this way, electron flow is blanked when power supply circuit 300 is operated in the blanking mode. However, even when operating in the blanking mode, some embodiments will still have some electrons that pass by the blanked dynodes. Nonetheless, the amount of electron flow in these embodiments will still be greatly reduced.

In some possible embodiments, the potential difference between adjacent dynodes is adjusted during the blanking mode so that it is in a range from about 50 percent to about negative 100 percent of the potential difference during the detection mode. For example, if the potential difference from dynode D4 to D5 is 100 volts during the detection mode, the potential difference from dynode D4 to D5 during the blanking mode is in a range from about 50 volts to about −100 volts. In another embodiment, the voltages at the adjacent dynodes are adjusted so that they are substantially similar. In one embodiment, the voltages at adjacent dynodes are substantially similar when they are within 10 percent of each other.

During the blanking mode, most of the electrons are not drawn toward the downstream dynode because the voltage is less than or substantially similar to the upstream dynode. As a result, the electrons will typically be absorbed by another structure within the detector. If the structure is not a dynode, the electron will typically not be detected by the detector. If the structure is another dynode, the velocity of the electron will typically not be great enough to liberate more electrons, such that the electron does not result in secondary emission at the detector.

As described in more detail herein, power supply circuit 300 is operated in the blanking mode, for example, at a time when the detector is expected to receive a known high abundance ion. In this way the detection of the high abundance ion is suppressed.

The illustrated embodiment of power supply circuit 300 operates in the blanking mode by utilizing pulse generator (Vpulse) and capacitive coupling C1 and C2. The pulse generator is electrically coupled to one of the dynode plates, such as dynode plate 210 (at D5). In the illustrated embodiment, the pulse generator includes isolating capacitor C3 and a resistive element R16.

In some embodiments, power supply circuit 300 begins to operate in the blanking mode by generating a voltage pulse with pulse generator Vpulse. In some embodiments, the voltage pulse is a negative voltage pulse that is supplied to one of the dynode plates (e.g., dynode plate 210 at D5). The negative voltage pulse is substantially similar to or greater than the potential difference between the dynode plate (e.g., 210 at D5) and the adjacent upstream dynode plate (e.g., dynode plate 210 at D4). As a result, the voltage at the dynode plate (e.g., 212 at D5) is reduced, such that the adjacent dynode plates have a substantially similar voltage, such that the electric field is eliminated, or at least reduced to such a level that most electrons will not flow to the downstream dynode (e.g., 212 at D5) from the upstream dynode (e.g., 210 at D4). In another embodiment, the voltage at the dynode plate (e.g., 212 at D5) is reduced such that the voltage is less than the upstream dynode (e.g., 210 at D4).

Capacitive coupling is electrically coupled to each adjacent dynode plate, including the upstream dynode plate (e.g., 208 at D4) and the downstream dynode plate (e.g., 212 at D6). The first capacitive coupling C1 is electrically coupled between Vcc and the upstream dynode plate (e.g., 208 at D4). The second capacitive coupling is electrically coupled between the downstream dynode plate (e.g., 212 at D6) and ground.

When operating in the detection mode, capacitive coupling C1 and C2 stores up energy. This energy is then used by capacitive coupling C1 and C2 when operating in the blanking mode, to maintain the voltage potential at the dynode plates to which they are electrically coupled. In this way, for example, the voltage at dynode plate 208 (D4) is maintained constant or relatively constant during the blanking mode. Without capacitive coupling C1, the voltage at dynode plate 208 (D4) would tend to adjust away from the voltage at dynode plate 210 (D5), resulting in an undesired electric field between the adjacent dynode plates during blanking. Although certain types, arrangements, and structures of capacitive coupling are described herein as used in a power supply circuit, other embodiments include other types, structures, structures, and arrangements for storing charge and energizing the dynodes.

In the illustrated embodiment the fourth and fifth dynodes (208 at D4 and 210 at D5) are used for blanking, such that the potential at the fifth dynode 210 is adjusted to be substantially similar to the voltage at the fourth dynode 208. In other embodiments, any two or more adjacent dynodes can be used for blanking.

One problem, however, of using the first and second dynodes, for example, is that ion 200 will sometimes travel through detector 108 and impact with one of the downstream dynodes (e.g., dynode 206) despite detector 108 being operated in the blanking mode. However, it has been found that ion 200 is less likely to bypass the blanking dynodes the further downstream they are. On the other hand, the further downstream the blanking occurs, the higher the current that will be generated in the upstream dynodes due to the impact of ion 200. If the blanking occurs too far downstream in the detector, such as at the thirteenth and fourteenth dynodes (e.g., 226 and 228), the upstream dynodes (e.g., dynode 212) will suffer from degradation from the excess current flow. As a result, it has been found to be beneficial in some embodiments to configure the power supply circuit 300 to supply the blanking pulse to a dynode located in a range from the fourth dynode to the seventh dynode. Other embodiments have other detector geometries that will benefit from having the blanking pulse delivered to a dynode outside of this range.

Power supply circuit 300 is operated in the blanking mode for a time period sufficient to suppress detection of one or more ions, such as a known high abundance ion. The time period varies in different embodiments based on factors such as the length of the flight tube, the acceleration of the ions, the ions to be blanked, and other factors. In one embodiment, the duration of the blanking pulse is in a range from about 100 picoseconds to about five nanoseconds. This range is typically sufficient to blank the detection of one or more undesired ions, but short enough so as to not inhibit detection of all subsequent ions.

After operating in the blanking mode, power supply circuit is operable to return the detector to the detection mode. Some embodiments will have a period of time that it takes for the power supply circuit to transition from the blanking mode back to the detection mode. For example, it will take dynode plate 210 some time to return to the appropriate detection mode voltage. In some embodiments, this restart time is in a range from about three nanoseconds to about ten nanoseconds. Therefore, the total time that power supply circuit 300 is blanked from detection of ions is the time of the blanking pulse plus the restart time. After the restart time has passed, the detector is operable to detect ion impacts with the detector.

A benefit of some embodiments according to the present disclosure is that the restart time is relatively short. One reason for this relatively short restart time is that some embodiments operate to adjust a dynode plate potential only tens or hundreds of volts during blanking, rather than a thousand or more volts. Switching of tens to hundreds of volts can be accomplished more rapidly than switching of a thousand or more volts, for example. Other embodiments operate to adjust the potential between the first dynode plate and the last dynode plate (and accordingly all intermediate dynode plates) to substantially the same voltage. Although these embodiments are also effective in inhibiting ion detection, the restart time will be relatively long because the entire voltage (e.g., 1400 volts) has to be reestablished. In contrast, by adjusting the potential between only two adjacent dynodes, only that portion of the voltage (e.g., 100 volts) has to be reestablished. As a result, the restart time after blanking is much faster Other embodiments are possible with various modifications to the illustrated embodiment. For example, some embodiments will adjust more than two dynode plates to have a substantially similar voltage when operating in the blanking mode. Other embodiments will not use a pulse generator (Vpulse) but will instead use a charge dumping, a switch (such as illustrated in FIG. 4), or other methods of voltage adjustment. In another embodiment, the power supply circuit operates to adjust the voltage at an upstream dynode to be substantially similar to or greater than the voltage at a downstream dynode, thereby blanking the detector.

FIG. 4 is an electrical schematic diagram of another exemplary embodiment of a power supply circuit 350 of detector 108. Power supply circuit 350 is very similar to power supply circuit 300, shown in FIG. 3, except that rather than using pulse generator (Vpulse, shown in FIG. 3) to adjust the voltage at a blanking dynode (e.g., 210 at D5), power supply circuit 350 utilizes a switch S1. When operating in the detection mode, switch S1 is maintained open, such that it does not influence the dynode voltages. The switch S1 is then closed by power supply circuit 350 to operate in the blanking mode. When switch S1 is closed, the blanking dynode (e.g., 210 at D5) is electrically coupled to the upstream dynode (e.g., 208 at D5). As a result, the voltage at the blanking dynode (e.g., 210 at D5) is adjusted to be substantially similar to the upstream dynode (e.g., 208 at D5), thereby blanking the detector. Capacitive coupling C1, C2, C3, and switch S2 operate to maintain the voltage at the upstream and downstream dynodes (e.g., 208 at D4 and 212 at D6) substantially constant during the blanking mode, and to quickly return the voltage to the appropriate levels when transitioning back to the detection mode. Switch S2 is operated opposite switch S1. For example, when switch S1 is open, switch S2 is closed, and when switch S1 is closed, switch S2 is open.

When power supply circuit 350 is operating in the detection mode, switch S1 is open and switch S2 is closed. At this time, capacitor C3 is charged due to the potential difference across resistor R6 (and between D5 and D6). To adjust to the blanking mode, switch S1 is closed and switch S2 is opened. Closing of switch S1 shorts the dynodes at D5 and D6 together, causing the voltage at each dynode to become substantially similar. At the same time, switch S2 is opened, such that capacitor C3 stores its charge during the blanking mode. When the blanking mode is complete, switch S1 is opened and switch S2 is closed. Upon closing of switch S2, the charge from capacitor C3 is discharged to the dynode at D5 to quickly restore the potential difference between the dynodes at D4 and D5 to return to the proper detection mode. Without switch S2 and capacitor C3, a recovery current must flow through resistor R6, possibly resulting in the time required to restore the voltage of the dynode at D5 to the proper potential being significantly longer. The delayed recovery could possibly result in a failure of the detector to detect a desired ion.

Figure 5:
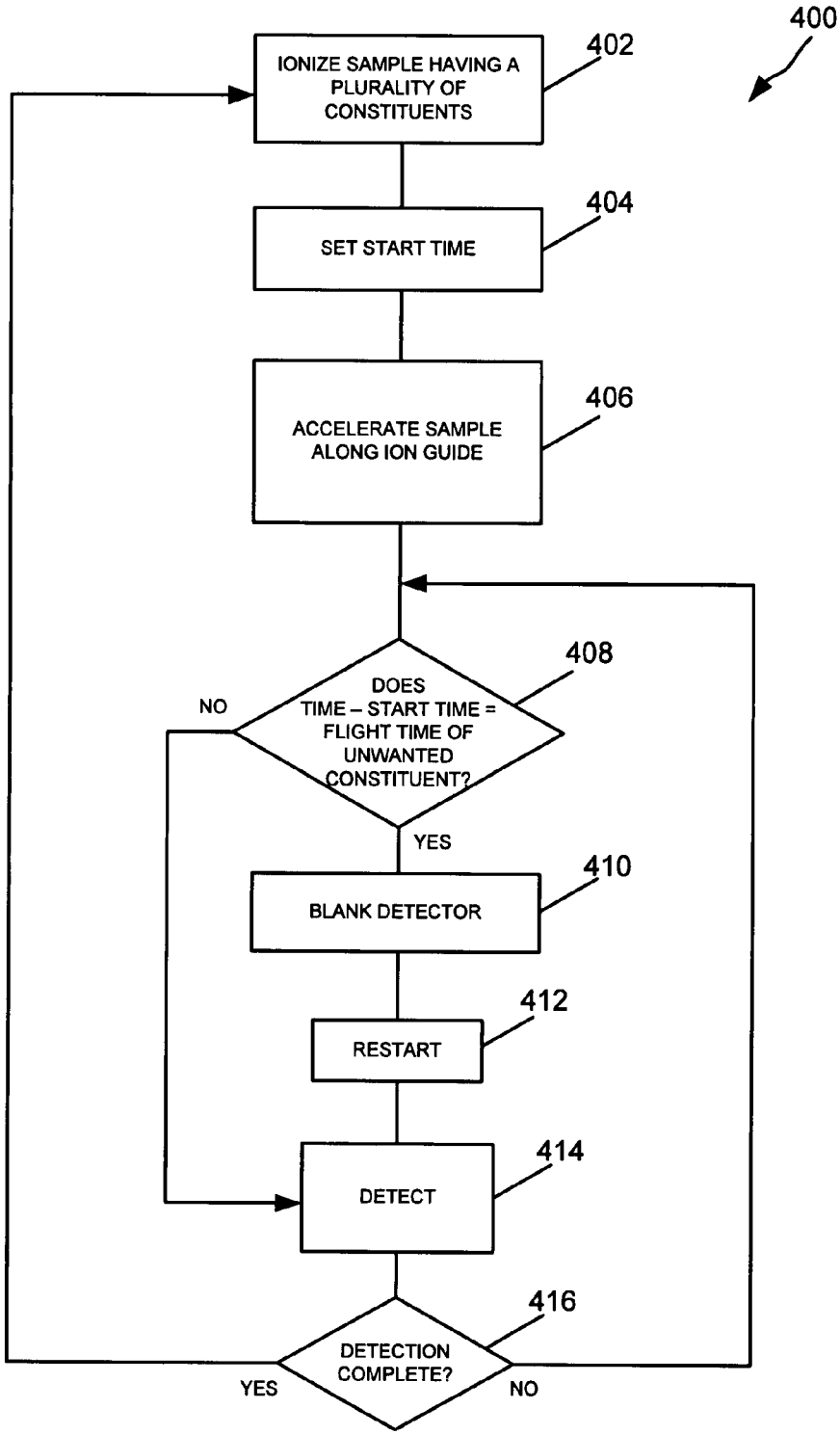
FIG. 5 is a flow chart illustrating an example method of operating the detector shown in FIG. 1.

FIG. 5 is a flow chart illustrating an example method 400 of detecting ions. Method 400 includes operations 402, 404, 406, 408, 410, 412, 414, and 416. Method 400 begins with operation 402 during which a sample is ionized having a plurality of constituents. In some embodiments, the sample includes an analyte of interest and a known unwanted constituent. It is desirable to detect the analyte of interest and to blank the detection of the unwanted constituent. In some embodiments, operation 402 involves ionizing the sample with ion source 104, such as shown in FIG. 1.

At the time that the sample is ionized, operation 404 is then performed to set a start time. In one embodiment, operation 404 involves checking a clock to determine a current time. In another embodiment, operation 404 involves resetting a clock to zero.

The sample is then accelerated into or along a flight tube in operation 406. In one embodiment acceleration of the ionized sample involves applying an electric field to the ionized sample to propel the ion into or along the flight tube, such as flight tube 106 shown in FIG. 1. Once in the flight tube, the ion separates from other ions having different masses.

Operation 408 is then performed to determine whether the current time minus the start time of operation 404 is equal to the flight time of the unwanted constituent. In some embodiments the flight time of the unwanted constituent is read from memory, such as measured and stored during a prior sampling. In another embodiment, the flight time is determined by looking up the flight time from a look up table according to the type of unwanted constituent. The flight time is compared to the difference between the current time and the start time. If they are equal, then operation 410 is performed. Otherwise, operation 414 is performed.

During operation 410 the detector is blanked to inhibit the detection of the unwanted constituent, which is predicted to be impacting the detector at approximately the present time. In some embodiments, operation 410 begins a short time period prior to the time determined in operation 408. Operation 410 continues for a predetermined time period. At operation 410, the detector begins to operate in the blanking mode. In some embodiments of operation 410, the potentials at two or more adjacent dynodes are adjusted such that they are substantially similar.

After operation 410, the detector is restarted in operation 412. In some embodiments, restarting of the detector involves a process of returning one or more dynodes to the appropriate detection voltages, such as by removing a supplied pulse, opening a switch, and other methods of voltage adjustment. In some embodiments, the termination of operation 412 marks the end of the blanking mode.

Operation 414 is performed to detect ion impacts, such as with detector 108, shown in FIG. 1. In some embodiments, operation 414 involves measuring a current or a voltage from an output electrode (e.g., electrode 230, shown in FIG. 2). Some embodiments also determine the time of detection of the ion, and store the data in memory. Some embodiments store both the time data and the current or voltage data, and associate the data together. In this way, data relating to both the mass and the abundance of the detected ion is stored. In some embodiments, the stored data is analyzed to generate an output spectrum indicative of the content of the sample.

Operation 414 is then performed to determine whether detection is complete. In some embodiments, operation 414 determines whether a current time minus the start time is equal to or greater than the maximum flight time of any analyte of interest in the sample. If so, operation 414 determines that detection is complete and returns to operation 402 to perform the next sample. If not, operation 414 returns to operation 408.

Some possible embodiments of method 400 include a process of automatic or manual calibration. For example, the detector can be operated without blanking for one or more samples to determine the time of flight of the unwanted constituent. If the unwanted constituent is a high abundance ion, the time of flight is easily determined by evaluating the resulting spectrum. The time of flight is then stored in memory and used for the decision of operation 408. In some embodiments, the calibration process is repeated on a regular basis to ensure that the appropriate time of flight is being used.

The exemplary embodiment of the electron multiplier described herein is used as part of an ion detector for a mass spectrometer. However, various embodiments of the electron multiplier can be used in different types of mass spectrometers other than the one described herein. It also may be used in applications other than mass spectrometry.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The invention claimed is:

1. An electron multiplier for detecting ion impact, the detector comprising:

a plurality of dynodes arranged in an electron cascading configuration, the plurality of dynodes including at least a first dynode and a second dynode arranged to receive electrons from the first dynode and defining a path;

a power supply circuit electrically coupled to the plurality of dynodes including the first and second dynodes, wherein the power supply circuit is arranged to selectively adjust a potential difference between the first and second dynodes between a first state in which the second dynode has a greater voltage than the first dynode and a second state in which the second dynode has a voltage substantially similar to or less than the first dynode.

2. The detector of claim 1, wherein the plurality of dynodes further comprises:

a series of dynodes including an entry dynode upstream of the first and second dynodes along the path and arranged to receive ions; and an exit dynode located downstream of the first and second dynodes along the path.

3. The detector of claim 2, wherein the plurality of dynodes comprises a number of dynodes in a range from 5 dynodes to 24 dynodes.

4. The detector of claim 3, wherein the plurality of dynodes comprises 15 dynodes.

5. The detector of claim 2, wherein the power supply circuit comprises:

a plurality of resistive elements, each resistive element electrically connected between adjacent dynodes of the plurality of dynodes arranged in the electron cascading configuration.

6. The detector of claim 5, wherein the plurality of resistive elements comprises:

a first resistive element electrically coupled between the entry dynode and a power source; and a second resistive element electrically coupled between the exit dynode and ground.

7. The detector of claim 6, further comprising a pulse generator electrically coupled to the first dynode to selectively adjust the voltage at the first dynode.

8. The detector of claim 7, further comprising:

a third dynode of the plurality of dynodes, the third dynode arranged immediately upstream of the first dynode along the path to supply electrons to the first dynode;

a fourth dynode of the plurality of dynodes arranged downstream of the second dynode to receive electrons from the second dynode;

a first capacitive coupling electrically coupled between the power source and the first dynode to maintain a substantially constant first dynode voltage throughout the first state and the second state; and a second capacitive coupling electrically coupled between the fourth dynode and ground to maintain a substantially constant fourth dynode voltage throughout the first state and the second state.

9. The detector of claim 2, wherein the power supply is arranged to apply a potential difference between the entry dynode and the exit dynode in a range from about 1,000 volts to about 20,000 volts.

10. The detector of claim 1, further comprising a switch electrically coupled between the first dynode and the second dynode for selectively adjusting the potential difference between the first and second dynodes between the first state and the second state.

11. The detector of claim 1, wherein during the second state a voltage difference between the first dynode and the second dynode is in a range from about 0 volts to about 10 volts.

12. The detector of claim 1, wherein during the second state a voltage difference between the first dynode and the second dynode is in a range from about 50 percent to about negative 100 percent of the voltage difference between the first dynode and the second dynode during the first state.

13. The detector of claim 1, further comprising:

a source for ionizing a sample; and a flight tube positioned to define an ion path between the source and the plurality of dynodes.

14. The detector of claim 13, further comprising:

a control system operatively connected to the source, the flight tube, and the power supply circuit; and an output device providing an output related to a content of the sample.

15. The detector of claim 14, wherein the control system is a field-programmable gate array.

16. A detector for detecting ion impact, the detector comprising:

an ion source for ionizing a sample to generate ions;

ion optics for receiving and focusing the ions from the ion source;

an flight tube positioned to define an ion path for the ions from the ion optics;

a plurality of dynodes in an electron cascading configuration and arranged to receive the ions from the ion path, the plurality of dynodes defining an electron path and comprising at least:

a first dynode;

a second dynode arranged to receive electrons from the first dynode;

a third dynode arranged immediately upstream of the first dynode along the electron path to supply electrons to the first dynode; and a fourth dynode arranged immediately downstream of the second dynode along the electron path to receive electrons from the second dynode; and a power supply circuit electrically coupled to the plurality of dynodes, the power supply circuit comprising:

a plurality of resistive elements, each resistive element electrically connected between adjacent dynodes of the plurality of dynodes arranged in the electron cascading configuration;

a pulse generator electrically coupled to the second dynode to selectively adjust a potential difference between the first and second dynodes between a first state in which the second dynode has a greater voltage than the first dynode and a second state in which the second dynode has a voltage substantially similar to the first dynode;

a first capacitive coupling electrically coupled between the power source and the third dynode to maintain a substantially constant third dynode voltage throughout the first state and the second state; and a second capacitive coupling electrically coupled between the fourth dynode and ground to maintain a substantially constant fourth dynode voltage throughout the first state and the second state.

17. A method of detecting ions from a sample, the method comprising:

receiving ions from an ion source at an electron multiplier, the ions including at least a wanted constituent and an unwanted constituent;

detecting impacts of the ions corresponding to the wanted constituent from the sample with a detector; and inhibiting detection of impacts of ions corresponding to the unwanted constituent from the sample.

18. The method of claim 17, wherein inhibiting detection of impacts comprises selectively adjusting a potential difference between a first dynode and a second dynode from a first state in which the second dynode has a greater voltage than the first dynode and a second state in which the second dynode has a voltage substantially similar to the first dynode to at least partially inhibit electron cascading from the first dynode to the second dynode.

19. The method of claim 18, wherein selectively adjusting the potential difference from the first state to the second state comprises inputting a voltage pulse from a pulse generator to the second dynode.

20. The method of claim 17 further comprising:

setting a start time when the ion source ionizes ions;

determining a flight time of the unwanted constituent; and wherein inhibiting detection of impacts occurs when a current time minus the start time is equal to the flight time of the unwanted constituent.

21. The method of claim 20, further comprising receiving a calibration sample of ions from the ion source; and wherein determining the flight time of the unwanted constituent comprises measuring the flight time of the unwanted constituent from the calibration sample.

22. The method of claim 20, wherein determining the flight time of the unwanted constituent is an operation selected from the group comprising: measuring the flight time of the unwanted constituent; reading the flight time from a lookup table; reading the flight time from memory; and calculating the flight time based on a mass of the unwanted constituent and a length of the flight tube.

23. The method of claim 17, wherein inhibiting detection of impacts lasts for a time period in a range from about 100 picoseconds to about 5 nanoseconds.

24. The method of claim 17, wherein the flight time is in a range from about 3 microseconds to about 200 microseconds.

* * * * *